United States Patent [19]

Bordini

[11] Patent Number: 4,838,325

[45] Date of Patent: Jun. 13, 1989

[54] METHOD AND AN ARRANGEMENT FOR A FILLING VALVE IN A PACKING MACHINE

[75] Inventor: Giorgio Bordini, Modena, Italy

[73] Assignee: Tetra Dev-Co, Modena, Italy

[21] Appl. No.: 130,940

[22] Filed: Dec. 10, 1987

[30] Foreign Application Priority Data

Dec. 16, 1986 [IT] Italy ..... 22706 A/86

[51] Int. Cl.[4] ..... B65B 3/04; B67C 3/28

[52] U.S. Cl. ..... 141/90; 141/91; 137/246; 134/166 R; 239/112

[58] Field of Search ..... 239/106, 112, 113; 141/98, 85, 89, 90, 91; 134/166 R, 169 R; 222/148; 137/244, 245, 245.5, 246

[56] References Cited

U.S. PATENT DOCUMENTS

| | | | |
|---|---|---|---|
| 833,259 | 10/1906 | Strasburger | 141/91 |
| 3,693,640 | 9/1972 | Wettlen et al. | 134/169 R |
| 3,716,083 | 2/1973 | Tuma et al. | 141/90 |
| 3,850,207 | 11/1974 | Loliger et al. | 141/90 |
| 4,213,795 | 7/1980 | Ernstsson et al. | 134/22 C |
| 4,218,265 | 8/1980 | Fuchs et al. | 134/18 |
| 4,318,431 | 3/1982 | Evans | 141/90 |
| 4,350,187 | 9/1982 | Trusselle et al. | 141/90 |
| 4,398,577 | 8/1983 | Sauer | 141/135 |
| 4,460,025 | 7/1984 | Scholle et al. | 141/90 X |
| 4,606,174 | 8/1986 | Berg | 53/451 |

FOREIGN PATENT DOCUMENTS

| | | | |
|---|---|---|---|
| 2048741 | 4/1972 | Fed. Rep. of Germany | 141/90 |
| 2539656 | 3/1977 | Fed. Rep. of Germany . | |
| 157300 | 4/1922 | United Kingdom | 239/106 |
| 2117492 | 10/1983 | United Kingdom . | |

*Primary Examiner*—Ernest G. Cusick

*Attorney, Agent, or Firm*—Burns, Doane, Swecker & Mathis

[57] ABSTRACT

In an arrangement for a filling valve on a packing machine after-dripping is prevented by providing that the outside surfaces of the valve which can come into contact with the contents are cleaned with the help of a pressure fluid during operation of the machine. An arrangement in accordance comprises a filling valve whose valve body is provided with a channel for the supply of pressure fluid and an outlet opening situated at the lower end of the valve body which conducts the pressure fluid and causes it to flow along the underside of the valve body so that any residue of the contents is effectively flushed away.

3 Claims, 1 Drawing Sheet

METHOD AND AN ARRANGEMENT FOR A FILLING VALVE IN A PACKING MACHINE

FIELD OF THE INVENTION

The present invention relates to a method for employing a filling valve in packing machine and an arrangement for carrying out the method.

BACKGROUND OF THE INVENTION

When in the packing industry individual or coherent, wholly or partly finished packing containers are filled, in particular with liquid contents, a filling pipe is generally used, which, among other things prevent splashing during the filling procedure, and is lowered wholly or partly into the packing container. When the filling has been completed a valve situated at the lower end of the filling pipe is closed so that the flow of contents is interrupted, and the filling pipe and the packing container respectively are displaced in relation to each other so that the filled packing container can be removed and a new packing container can be made ready for filling. In the well-known type of packing machines which manufacture packing containers from flexible tubular material, this procedure corresponds to a transverse seal being carried out at some distance below the bottom end of the filling pipe, whereupon the subsequent package begins.

When a packing container has been filled with the desired volume of contents and had been displaced in relation to the filling pipe, some form of processing operation generally takes place, e.g. in that the top part of the package is formed and closed or the tubular packing material is sealed transversely. It is of greatest importance here that the flow of contents from the filling pipe is truly effectively interrupted so that no contents drip down and hinder the sealing work or soil the outside of the package or surrounding machine parts. On filling of powdery material, this is generally no problem, but when the contents consist of liquid material, especially such of high viscosity or liquid materials containing particles, there is a danger of the material or the particles sticking to the bottom end of the filling pipe e.g. on the outside of the valve located there, and after the closing of the valve drip down from the filling pipe.

OBJECTS AND SUMMARY OF THE INVENTION

It is thus an object of the present invention to provide a method which makes it possible to prevent after-dripping from a filling valve in a packing machine.

It is a further object of the present invention to provide a method which makes it possible during operation to clean the outer parts of the filling valve which are subject to splahing or in some other manner come into contact with the contents, and prevent the contents from adhering to, and dripping down from, these parts.

It is a futher object of the present invention to provide such a method which is applicable to all types of known packing machines, irrespectively of whether these are intended for the filling of individual, partly preformed, packing containers or for working with tubular packing material.

These and other objects have been achieved in accordance with the invention in that a method for a filling valve in packing machines has been given the characteristic that parts of the outer surfaces of the valve are cleaned by means of pressure fluid.

Preferred embodiments of the method in accordance with the invention have been given, moreover, the characteristics which are evident from the dependent claims.

Through cleaning the valve, or more particularly certain parts of the outer surfaces of the valve which may come into contact with the contents, by means of a pressure fluid, it is possible effectively to prevent any after-drip. The pressure fluid preferably is made to flow along the surfaces which are to be cleaned and since cleaning in this way will be effective, the supply of pressure fluid can be of very short duration. The quantity of pressure fluid which is introduced into each packing container will be small, therefore, and by a judicious choice of pressure fluid any negative effect upon the filled product can be avoided.

It is a further object of the present invention to provide an arrangement for the implemetation of the method, this arrangement being simple and well-suited for application together with existing types of filling pipes and packing machines.

These and other objects have been achieved in accordance with the invention in that an arrangement for a filling valve in packing machines has been given the characteristic that the valve is provided with a channel for pressure fluid, this channel having an outlet opening which is directed towards, and is arranged to make possible the blowing clean of, the lower, outer surface of the valve.

Preferred embodiments of the arrangement in accordance with the invention have been given, moreover, the characteristics which are evident from the dependent claims.

The design of the arrangement permits an effective cleaning of the outer surfaces of the valve, that is to say the lower end of the valve or feeding pipe including the valve seat arranged there as well as the underside of the valve body. The design is simple and can easily be adapted to the filling pipe and the valve set-up in known packing machines.

BRIEF DESCRIPTION OF THE DRAWING

Preferred embodiments of the method and the arrangement in accordance with the invention will now be described in greater detail with special reference to the attached schematic FIGS. of the drawing wherein only the details indispensable for the understanding of the invention are shown and wherein.

DETAILED DESCRIPTION OF A PREFERRED EMBODIMENT

Figure 1:
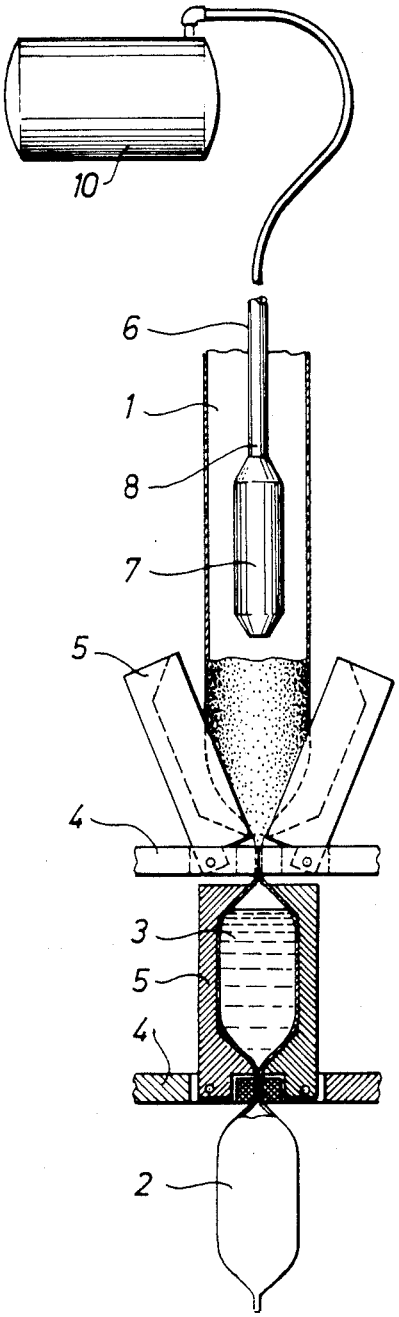
FIG. 1 is a schematic side view partly in section of a part of a known packing machine which is provided with an arrangement in accordance with the invention.

In FIG. 1 is shown the arrangement in accordance with the invention mounted in a packing machine of the type which produces individual packing containers filled with contents by transverse sealing of a tube of flexible packing material. This type of machine is well-known and is described in more detail e.g. in U.S. patent no. 4,666,174, to which reference is made. The method and the arrangement in accordance with the invention are not limited, however, to being used in this type of packing machine, but can be used in any type of packing or filling machine, provided only that it is equipped with a suitable filling pipe comprising a valve.

In FIG. 1 is shown how the packing machine known in itself processes and converts a tube 1 of flexible packing material which surface layers of thermoplastics to packing containers 2 which are wholly or partly filled with contents 3. The packing machine comprises a number of co-operating sealing jaws 4 which, in pairs, periodically flatten the tube in a transverse region and provide a liquid-tight seal, e.g. through the supply of heat and suitable pressure, so that the thermoplastic layers of the packing material fuse together. The packing machine also comprises forming flaps 5 which ensure the desired conversion of the crossectional shape of the packing material tube, preferably to rectangular shape so as to facilitate, through subsequent processing and folding-in of corners on the separated packing containers, the desired conversion to individual packing containers of parallel-epipedic shape.

In the packing material tube a filling pipe 6 is present with a filling valve 7 arranged at its lower end which is maneuverable by means of a maneuvering rod 8 extending vertically through the filling pipe 6. The filling valve 7 is connected via a channel 9 (FIG. 2) in the maneuvering rod 8 to a source of pressure fluid 10 which will be described in more detail in the following.

Figure 2:
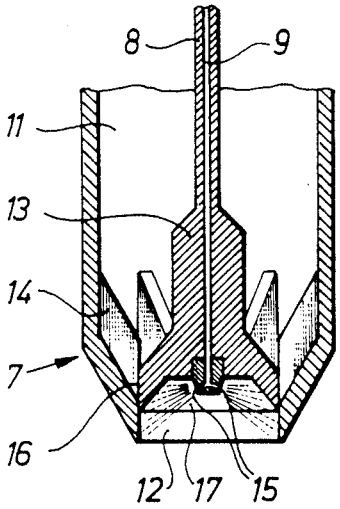
FIG. 2 is a schematic view on a larger scale and partly in section of a part of a filling valve with a first embodiment of the arrangement in accordance with the invention, and FIG. 3 corresponds to FIG. 2, but is a view of a second embodiment of the arrangement in accordance with the invention.

In FIG. 2 is shown on a larger scale and partly in section the lower end of the filling pipe 6 with the filling valve 7 according to FIG. 1. The filling valve 7 comprises more particularly a valve housing 11 which is mainly cylindrical with a conically tapering lower end. The lower end of the valve housing is open so as to make possible the flowing out of the contents from the filling pipe 6 via the valve housing 11 and is designed as a valve seat 12, which is substantially cylindrical. The filling valve 7 can be opened and shut through maneuvering of a valve body 13 located in the valve housing 11 by means of the manuevering rod 8 mentioned earlier which at its top end is in connection with a manuevering device, not shown, e.g. a pneumatic piston and cylinder unit or a cam. The valve body 13 has at is lower end a circular sealing surface which in closed position of the valve co-operates with the valve seat 12. When the valve body 13 is raised by means of the maneuvering rod 8 it is retained coaxially in the valve housing 11 with the help of guides 14 which are distributed around the inside of the circumference of the valve housing 11 and form vertical guiding surfaces which constitute the continuation of the cylindrical surface of the valve seat 12.

The lower end of the valve body 13 is mainly in the shape of a cone whose lower end or base has a diameter which substantially corresponds to the valve seat 12 and has a circular sealing surface 16. In the valve body 13 a correspondingly conical, cup-shaped recess 17 is present underneath, on the upper boundary wall of which the channel 9 ends in an outlet opening 15. The outlet opening 15 may be in the form of a spreader element or nozzle which as the pressure fluid is pressed through the channel 9 spreads the same in conical form downwards so that it flows along the inner, conical boundary surface in the lower end of the valve body 13.

During operation of the packing machine the packing material tube 1 is advanced in downwards direction through the machine with the help of the two pair of sealing jaws 4, which alternately seize and flatten the material tube and move downwards over a distance which corresponds to the length of a packing container. At the same time as a part of the packing material is flattened with the help of the sealing jaws heat is supplied in the flattened region, which ensures that the thermoplastic layers on the insides of the packing material tube 1 pressed against each other fuse together to a liquid-tight seal. This procedure, as well as the main function and design of the packing machine, are well-known and described in more detail in the Swedish patent specification No. 8401288-9 mentioned earlier, to which reference is made for further clarification of details of the design and function.

As soon as the packing material tube 1 has been provided with a transverse seal at its lower end, the contents are fed via the filling pipe 6, which is located substantially coaxially in the packing material tube and whose lower end, that is to say the filling valve 7, is slightly above the position where the upper pair of sealing jaws 4 flattens the packing material tube 1. As soon as a transverse sealing of the packing material tube 1 has been completed, the filling valve opens by the valve body 13 being raised with the help of the manoeuvering rod 8 so that the circular sealing surface 16 situated at the lower end of the valve body leaves the valve seat 12 and rests against the top end of the guides 14 situated in the valve housing 11. Via the interspace between guides 14 the contents can now flow freely between the circular sealings surface of the valve body 13 and the valve seat 12 so that the packing material tube 1 is filled to the desired level with contents, whereupon the valve body 13 is moved downwards again by means of the maneuvering rod 8 until the circular sealing surface 16 and the valve seat 12 interrupt the flow of contents. Thereafter, with the help of the sealing jaws 4, a renewed sealing of the packing material tube takes place, the packing material tube at the same time being advanced downwards and being form-processed by means of the forming flaps 5, which swivel against one another and between them transform the tube to the desired rectangular shape.

When the filling valve 7 closes, that is to say the flow of contents is cut off owing to the valve body 13 being displace downwards so that its circular sealing surface 16 slides down and seals against the valve seat 12, it is of the greatest importance that the flow of contents through the filling valve 7 should be interrupted instantly and completely, since otherwise residual contents may fall down between the sealing jaws 4 during its sealing movement and hinder a complete transverse sealing of the packing material tube. While it is possible in this type of valve to ensure a good sealing and closing function with most types of contents, it may happen that contents adhere to the lower end of the contents valve, that is to say around the valve seat 12 and at the lower, cup-shaped part 17 of the valve body 13. To avoid this danger use is made in accordance with the invention of the outlet opening 15 located centrally at the lower end of the vale body 13 for supplying a pressure fluid via the channel 9 in the maneuvering rod 8 which with the help of a spreading element or nozzle at the outlet opening 15 is directed so that the outer body 13 and the valve seat 12 that may be exposed to the product) are cleansed. This is done preferably by causing the pressure fluid to flow along the underside of the valve body in the direction towards the surrounding valve seat 12 at the same time as the valve body 13 performs it downwards-directed closing movement. At this time pressure fluid will flush clean the lower surface of the valve seal 12 and the cup-shaped recess 17 at the lower end of the valve body. The presssure fluid is passed from the source of pressure fluid 10 indicated in FIG. 1, which may be a pressure tank with a suitable pressure fluid, a pump or any other suitable device of a known type. The pressure fluid is supplied during a very short period of the same time as the valve carries out its closing movement, and in known types of machines which produce approx. 5-6000 packing containers per hour a typical value for the pressure fluid supply time is approx. 0.1s, maximum 0.2s. The quantity of pressure fluid furnished will be very small and the effect on the contents in the packing containers (e.g. dilution of the same) will be negligible.

The supply of pressure fluid can be controlled in respect of time and duration by a number of different methods, e.g. by means of a valve of conventional type located in the connection between the source of pressure fluid 10 and the valve body 13, this valve (not shown in the FIG.) opening and closing the time with the working movements of the valve body 13. The valve may be actuated by means of the maneuvering device which actuates the valve body 13. As the fluid is not supplied via a pressure tank, the dosing and synchronizing with working movements of the valve body 13 may take place also with the help of a reciprocating pump (not shown) which appropriately is actuated by means of the maneuvering device of the valve body 13.

Figure 3:
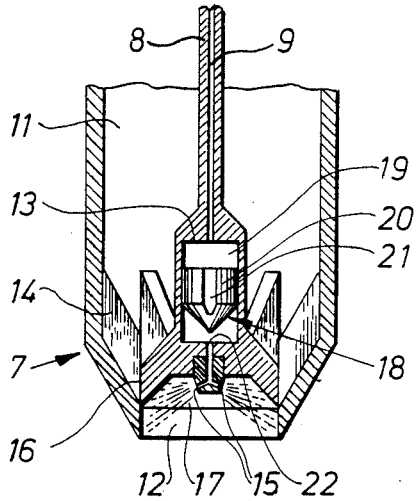

An arrangement for the control of the fluid supply comprises in accordance with another embodiment of the invention (FIG. 3) a valve arrangement 18 which is arranged in series with the channel 9 and is situated in the valve bdoy 13 or its maneuvering rod 8. The valve arrangement comprises a chamber 19, which constitutes a part of the channel 9, and a valve cone 20 located in the chamer 19 whose lower end can seal against a valve seat 22 at the part of the channel 9 which leads to the outlet opening 15. The valve cone 20 is freely movable in vertical direction, that is to say along the longitudinal axis of the valve body 13, and on reciprocating movements of the valve body the valve cone, owing to the forces of inertia, will move alternatively to and fro in relation to the valve seat 22 so that the valve arrangement 18 opens and closes in time with movements of the valve body 13. In reality, of course, the valve cone 20, owing to its inertia, will be more or less stationary whilst the valve seat 22 is moved to and fro together with the valve body 13. The valve seat 22 and the lower end of the valve cone 20 co-operating with the seat thus will separate (that is to say the valve arrangement 18 is opened) when the valve body 13 is moved downwards so that fluid is sprayed out via the nozzle 15 when the filling valve 7 closes. When the filling valve opens and the valve body 13 is moved upwards the valve cone 20 will be pressed against the seat 22, so that the valve arrangement 18 closes and interrupte the outflow of fluid via the nozzle 15 as the filling valve opens. The fluid can pass the valve cone 20 via a passage 21 provided in the cone 20 or in the wall of the chamber 19 and, provideed the fluid is supplied to the channel 9 at a suitable pressure, the outflow via the nozzle is thus controlled wholly by the valve arrangement 18. The simple construction of the same and the absence of separate maneuvering devices entail great advantages from an economic viewpoint in its manufacture as well as during operation. The valve arrangement requires no maintenance and can be cleaned and sterilized simply in connection with the corresponding treatment of the machine as a whole. The valve arrangement is synchronized automatically with the opening and closing movements of the valve body 13 and there is no need, therefore, to apprehend any faulty opening or closing time even after a prolonged period of operation.

Naturally the pressure fluid to be used must be adapted to the packed contents so that it does not in any way influence their flavor or appearance or in some other way have a negative effect on the package or its contents. In the packaging of foodstuffs of the type of milk or diary products, soups or semiliquid articles of food of different types it is preferable, therefore, to use an inert gas which, by being supplied in connection with the closing movement of the valve immediately before the packing container is closed (e.g. through the material tube being flattened and sealed by the sealing jaws), will also fill the top part, so-called head-space, of the packing container formed which improves the keeping quality of the contents. It is also appropriate for the pressure fluid to be sterile and consist, e.g. of sterile gas or steam. If desired, of course, the pressure fluid may be used intentionally for influencing the packed product in that a substance which exercizes the desired influence, can be metered in exact doses into the packing containers with the help of the arrangement in accordance with the invention e.g. in order to flavor the contents.

By directing the jet from the conical recess 17 of the valve body and ensuring that the jet is of a conical shape such that it strikes the inner, conical surface of the valve body 13, it will be "isolated" from the contents so that any splash or particles in the contents are fully prevented from reaching, or adhering to, the valve body 13 and surrounding valve seat 12. When the filling valve 7 is in open position, that is to say when the valve body 13 is inside the filling pipe with its lower, circular sealing surface in contact against the guides 14, the outlet opening 15 will direct the conical pressure fluid jet downward towards the opening of the filling pipe and the valve seat 12 present there so that these are effectively cleansed in connection with the closing of the valve.

If steam is used as a pressure fluid this will condense in the packing container so that the quantity of gas or air (head space) in the closed package is reduced which may be an advantage in respect of the appearance of the packing container. Naturally it is possible to choose a combination of different types of pressure fluids so that the desired result (effect on head space volume, effect on contents etc.) is obtained.

While this invention has been illustrated and described in accordance with a preferred embodiment, it is recognized that variations and changes may be made and equivalents employed herein without departing from the invention as set forth in the claims.

What is claimed is:

1. A filling valve for use in filling operations of a packing machine comprising a filling valve outer surface and a pressure fluid channel having an outlet opening directed towards the outer surface and adapted to permit pressure fluid fed through the channel to be directed onto the outer surface of the valve body to clean the body between filling operations, the channel having a valve arrangement which is adapted to open during a downwardly directed closing movement of the valve body and to close during the upwardly directed opening movement of the valve body.

2. The arrangement in accordance with claim 1, wherein the valve arrangement has a chamber and a freely movable valve cone which is located in the chamber, the lower end of the chamber having a valve seat cooperating with the valve cone.

3. The arrangement in accordance with claim 2, wherein one of the valve cone and the chamber has a passage through which the fluid can flow past the valve cone.

* * * * *